US007024903B2

(12) United States Patent
Schmauder et al.

(10) Patent No.: US 7,024,903 B2
(45) Date of Patent: Apr. 11, 2006

(54) BENDING SYSTEM WITH MULTILEVEL BENDING TOOL

(75) Inventors: Frank Schmauder, Metzingen (DE); Winfried Richter, Aichtal-Grötzingen (DE); Thilo Eichenbrenner, Gammertingen (DE)

(73) Assignee: Trumpf Rohrtechnik GmbH & Co. KG, Reutlingen-Mittelstadt (DE)

( * ) Notice: Subject to any disclaimer, the term of this patent is extended or adjusted under 35 U.S.C. 154(b) by 240 days.

(21) Appl. No.: 10/800,589

(22) Filed: Mar. 15, 2004

(65) Prior Publication Data

US 2004/0200253 A1 Oct. 14, 2004

(30) Foreign Application Priority Data

Mar. 15, 2003 (EP) ..... 03005461

(51) Int. Cl.
*B21D 7/04* (2006.01)

(52) U.S. Cl. ..... 72/149; 72/157

(58) Field of Classification Search ..... 72/149, 72/154, 157, 159
See application file for complete search history.

(56) References Cited

U.S. PATENT DOCUMENTS 4,495,788 A * 1/1985 Traub ..... 72/157
5,263,350 A * 11/1993 Crippa ..... 72/157
5,689,988 A * 11/1997 Schwarze ..... 72/157
6,038,903 A * 3/2000 Traub ..... 72/149
6,655,183 B1 * 12/2003 Fan ..... 72/157

FOREIGN PATENT DOCUMENTS

| | | |
|---|---|---|
| DE | 3327509 | 7/1995 |
| DE | 19919508 | 3/2000 |
| GB | 2187666 | 9/1987 |

OTHER PUBLICATIONS

Mewag Innovation Edition 12 Biegeteile fur Jagdflugzeuge.

* cited by examiner

*Primary Examiner*—Derris H. Banks
*Assistant Examiner*—Teresa M. Bonk

(57) ABSTRACT

A bending system (1) on a bending machine for bending rod shaped and/or bar-shaped workpieces and especially pipes (4), incorporates at least one multilevel bending tool (3) with multiple bending levels arranged one above the other in the direction of a bending axis (8). For each bending level a bending die (5, 6, 7) and, associated with the corresponding bending die (5, 6, 7), at least one clamping jaw (8, 9, 10) and at least one slide rail (18, 19, 20) are provided. The clamping jaws (8, 9, 10) are effectively supported by means of a modular clamping jaw support (24), the slide rails (18, 19, 20) by means of a modular slide rail support (44) in the transverse direction of the bending axis (8) and in the transverse direction of the workpiece, respectively. Clamping jaw support units (28, 29, 30) and slide rail support units (33, 33*a*, 34, 34*a*, 35, 35*a*) of which the clamping jaw support (24) and, respectively, the slide rail support (44) is composed, are appropriately configured.

14 Claims, 5 Drawing Sheets

BENDING SYSTEM WITH MULTILEVEL BENDING TOOL

BACKGROUND OF THE INVENTION

This invention relates to a bending system on a bending machine for bending rod shaped and/or bar-shaped workpieces and especially pipes, and employing at least one multilevel bending tool that features several bending levels situated one above the other in the direction of a bending axis. The system includes for each bending level a bending die and, associated with the respective bending die, at least one clamping jaw that can be moved in the transverse direction of the bending axis between at least one operating position next to the bending die and at least one idle position at a distance from the bending die, with the clamping jaw or jaws on the side facing away from the bending die or dies effectively braced in the transverse direction of the bending axis by a clamping jaw support unit that is movable in the transverse direction of the bending axis. In addition, a bending die and at least one slide rail are provided for each bending level for bracing the workpiece in the transverse direction of the workpiece, and the side rail or rails are effectively mounted on a slide rail support in the transverse direction of the workpiece on the side facing away from the workpiece. The invention also relates to clamping jaw support units as well as slide rail support units for bending systems of the type referred to above.

Bending systems in this general category have been described in German Patent 33 27 509 C2. In the prior art multilevel bending tools the clamping jaws are mounted, on the side facing away from their respectively associated bending dies, on a single unit buttress block in the transverse direction of the bending axis of the multilevel bending tool. Accordingly, the slide rails in the prior art multilevel bending tools are supported in the transverse direction of the workpiece. Each buttress block extends across all bending levels of the multilevel bending tool concerned.

It is the objective of this invention to add flexibility to the design of such earlier bending systems.

SUMMARY OF THE INVENTION

It has now been found that the foregoing and related objects may be readily attained in a bending system in a bending machine for bending rod shaped and bar-shaped workpieces incorporating at least one multilevel bending tool with multiple bending levels arranged one above the other in the direction of a bending axis. The bending tool has at each bending level a bending die and, associated with a corresponding bending die, at least one clamping jaw movable in the transverse direction of the bending axis into at least one operating position next to the bending die and into at least one idle position away from the bending die. The clamping jaw is effectively mounted on the side facing away from the bending die on a clamping jaw support that can be moved in the transverse direction of the bending axis. The clamping jaw support encompasses several clamping jaw support units positioned one above the other in the direction of the bending axis and detachably connected to one another, and the clamping jaw support units are distributed over different bending levels.

Desirably, at least one clamping jaw is provided at each of the different bending levels and clamping jaw support units are distributed over the different bending levels associated with the clamping jaws. The bending tool has at each bending level a bending die and at least one slide rail for bracing the workpiece in the transverse direction of the workpiece and in which, on the side facing away from the workpiece in the transverse direction of the workpiece, the slide rail is effectively mounted on a slide rail support which encompasses several slide rail support units positioned one above the other in the direction of the bending axis. The slide rail support units are associatively distributed over different bending levels and detachably connected to one another. At least one slide rail is provided for each of the different bending levels and the respective slide rail support units associated with the slide rails are correspondingly distributed over the different bending levels.

At each bending level, a clamping jaw is associated with the corresponding bending die and is movable in the transverse direction of the bending axis into at least one operating position next to the bending die. On the side facing away from the bending dies the clamping jaw is effectively mounted in the transverse direction of the bending axis on a clamping jaw support unit that is movable with the clamping jaw(s) in the transverse direction of the bending axis. The clamping jaw support encompasses several clamping jaw support units that are positioned one above the other in the direction of the bending axis and detachably connected to one another, and the respectively associated clamping jaw support units are correspondingly distributed over the different bending levels.

Preferably, at least one clamping jaw support unit and at least one slide rail support unit are identical in their structural design. At least one clamping jaw of at least one bending level is adjustably mounted on the associated clamping jaw support unit or units in a manner to permit being repositioned especially in the transverse direction of the bending axis. At least one slide rail at at least one bending level is adjustably mounted on the associated slide rail support units for repositioning the workpiece.

The clamping jaw support units and the slide rail support units are categorized by their respective designs or by their linear dimension in the transverse direction of the bending axis, and the slide rail support units are categorized by their linear dimension in the transverse direction of the workpiece.

The present invention provides for a modular design of the clamping jaw support and the slide rail support of the multilevel bending tool. By virtue of this novel modular design, the clamping jaw supports or the slide rail supports can be configured bending level by bending level, thus allowing the clamping jaw support or the slide rail support to be completely configured to adapt to the specific processing requirements. In particular, it is possible to define the "interference contour" created by the clamping jaw support or slide rail support on a case by case basis. A suitable setup of clamping jaw or slide rail support units permits the creation of a geometric layout of clamping jaw supports or slide rail supports that eliminates process disrupting collisions between the workpiece being processed and the clamping jaw support or slide rail support. It is equally possible for instance to adapt the configuration of the clamping jaw support or slide rail support to specific load or bending force requirements. For example, if high support strength is needed, an appropriate load bearing configuration of clamping jaw or slide rail support units can be selected.

In the context of this invention, a modular design concept for the clamping jaw support or slide rail support lends itself well to cases where not all bending levels of the multilevel bending tool are equipped with at least one clamping jaw or at least one slide rail, thus requiring the clamping jaws or slide rails to be realigned in the direction of the bending axis and to be set up at the bending level required for the particular process at hand. According to the invention, it is equally possible to employ bending dies on all bending levels or only on some of them.

The novel bending system offers the ability to use the same component as either a clamping jaw support unit or as a slide rail support unit and to interchange clamping jaw support units and slide rail support units.

An enhanced implementation of the invention permits the use of clamping jaw and/or slide rail support units for the adjustment of clamping jaws especially relative to their respectively associated bending die, and of slide rails especially relative to the workpiece to be held in place. At the same time, the clamping jaw and slide rail support units permit the attachment and detachment of the clamping jaws and slide rails they support. The bending systems according to the invention thus make it possible to manipulate the clamping jaw support units with their associated clamping jaws and slide rail support units with their associated slide rails as application specific equipment components of the bending system and, whenever these components are not in use, to retain them at their last setting.

The clamping jaw support units and the slide rail support units of the bending systems of this invention can be categorized by their respective design and especially in terms of their dimension in the transverse direction of the workpiece and their dimension in the direction of the bending axis. Such categorization significantly facilitates the selection of clamping jaw and slide rail support units for the appropriate configuration of clamping jaw and slide rail supports. Clamping jaw and slide rail support units categorized and labeled by their design may be combined within one and the same category, but also from different categories. Categorization according to this invention permits the use of clamping jaw and slide rail support units in the manner of modular building blocks of a support unit construction kit.

BRIEF DESCRIPTION OF THE DRAWINGS

The following described embodiment will explain this invention in more detail with the aid of schematic illustrations in which.

DETAILED DESCRIPTION OF THE ILLUSTRATED EMBODIMENT

Figure 1:
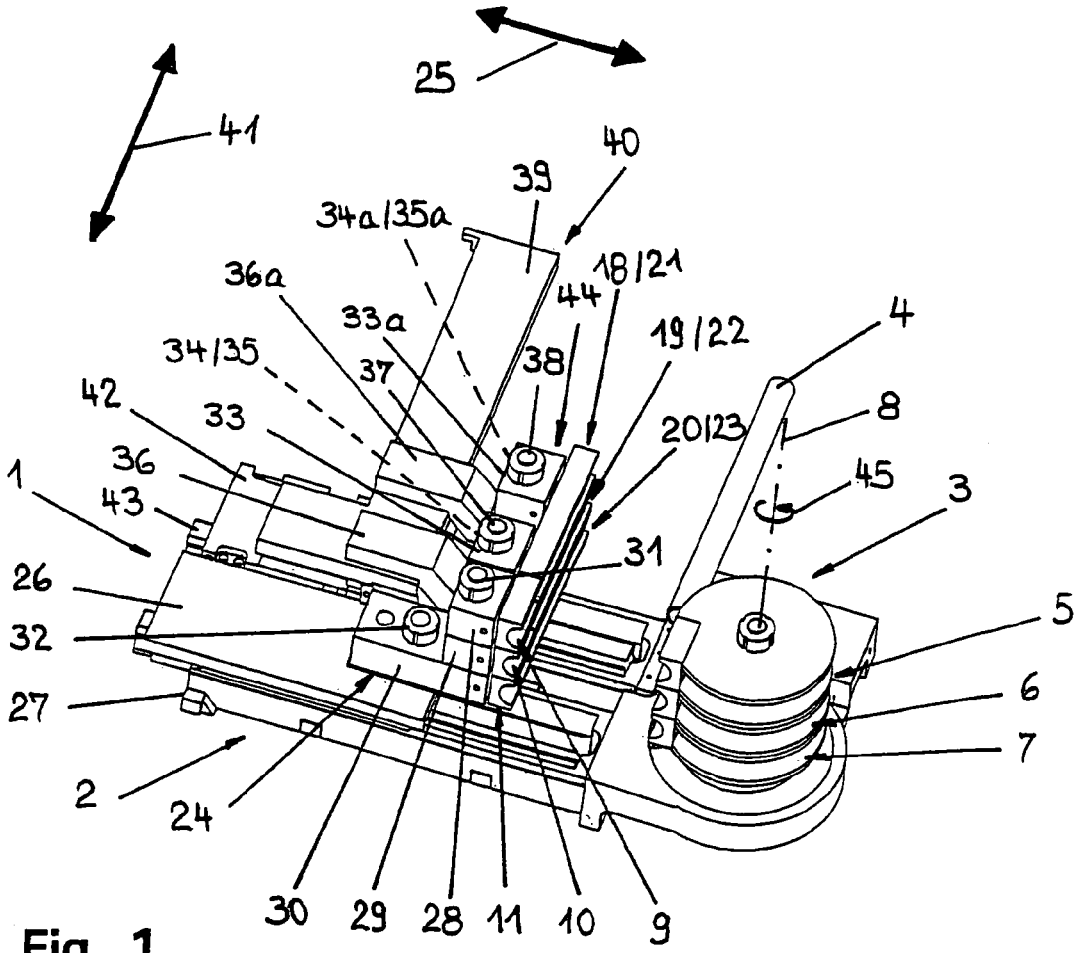
FIG. 1 is a perspective view of a bending system with a multilevel bending tool of a first design, and prior to the bending process.
Figure 2:
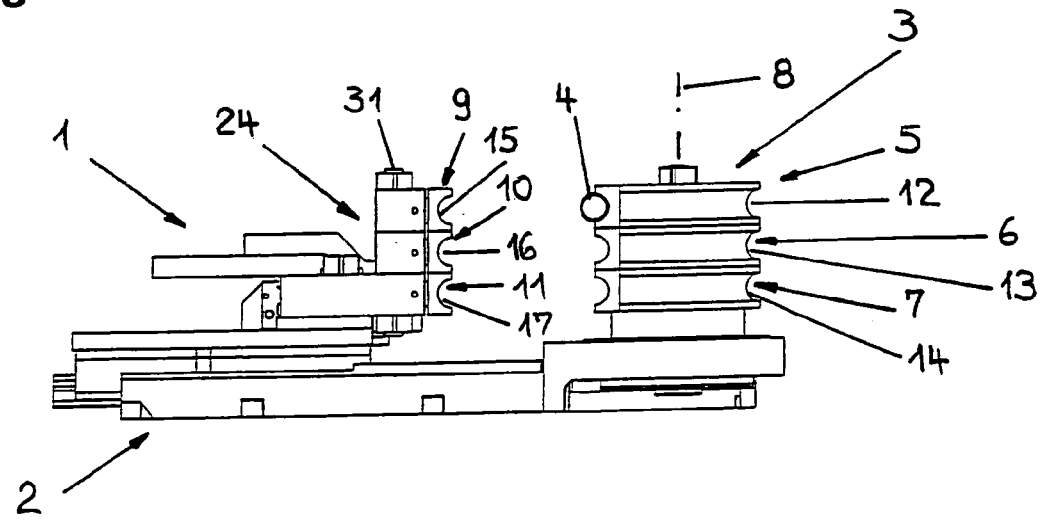
FIG. 2 is a frontal top view of the bending system of FIG. 1.

As shown in FIGS. 1 to 4, the bending system 1 encompasses a base structure 2 and, mounted thereon, a multilevel bending tool 3. The bending system 1 is attached to the front end of the machine frame (not shown), of a bending machine. In conventional fashion a workpiece feed carriage or slide with a collet chuck can be moved along the machine frame. The collet chuck holds the machine side end of a workpiece, in this case a pipe 4. Turning the collet chuck around the axis of the pipe and moving the workpiece feed carriage in the longitudinal direction of the pipe positions the pipe 4 for the bending process.

The multilevel bending tool 3 employed for processing the pipe 4 by the uncoil and stretch bending method includes the bending dies 5, 6, 7 that are positioned one above the other at a total of three bending levels in the direction of a bending axis 8. The bending dies 5, 6, 7 are associated with clamping jaws 9, 10, 11 which on their part are positioned one above the other in the direction of the bending axis 8. Bending die channels 12, 13, 14 are positioned opposite clamping jaw channels 15, 16, 17.

In traditional fashion, the bending die channels 12, 13, 14 and the clamping jaw channels 15, 16, 17 of the same bending level are geometrically matched. When the multilevel bending tool 3 is closed, the bending die channels 12, 13, 14 and the clamping jaw channels 15, 16, 17 combine to form a workpiece holder with an essentially circular cross section. In the case of the example illustrated the bending die channels 12, 13, 14 and the clamping jaw channels 15, 16, 17 are so contoured at the different bending levels that they result in slightly different diameters of the workpiece holders. The design implementations illustrated thus permit the bending of pipes with three different diameters.

Other tool components of the multilevel bending tool 3 include slide rails 18, 19, 20 mutually juxtapositioned in the direction of the bending axis 8. The slide rail channels 21, 22, 23 on the slide rails 18, 19, 20 are shaped in the same fashion as the clamping jaw channels 15, 16, 17.

On their side facing away from the bending dies 5, 6, 7, the clamping jaws 9, 10, 11 are attached to a clamping jaw support in the form of a clamping block 24. Together with the clamping jaws 9, 10, 11 attached to it, the clamping block 24 can travel in the direction of the double arrow 25, i.e., in the transverse direction of the bending axis 8. This allows the clamping jaws 9, 10, 11 to be moved into an operating position next to the bending die or into an idle position at a distance from the bending die. The movement of the clamping jaws 9, 10, 11 in the direction of the double arrow 25 takes place by means of a platen 26 that is guided in that direction of travel by a swivel arm 27 on the base 2. The necessary connection between the clamping jaws 9, 10, 11 and the platen 26 is established by the clamping block 24.

The clamping block 24 is modular in design, comprised in the example shown of clamping jaw support units 28, 29, 30 which, in the direction of the bending axis 8, are positioned one above the other while on the clamping jaw side they are mutually tied together by means of a tie rod 31. The assembly of clamping jaw support units 28, 29, 30 coupled with the aid of the tie rod 31 is attached to the platen 26 by a mounting screw 32. The mounting screw 32 extends through the bottom-most clamping jaw support unit 30 of the clamping block 24. The dimension of the clamping jaw support unit 30 in the transverse direction of the bending axis 8 is three times that of the corresponding dimension of the clamping jaw support units 28, 29. In the longitudinal direction of the pipe 4 and in their elevation in the direction of the bending axis 8 the clamping jaw support units 28, 29, 30 are of the same size. In terms of their design the clamping jaw support units 28, 29 are identical. The clamping jaw 9 is attached to the clamping jaw support unit 28 in removable fashion. The clamping jaw 10 and the clamping jaw 11 are similarly attached to the clamping jaw support units 29 and 30, respectively.

The slide rail support units 33, 33*a*, 34, 34*a*, 35, 35*a* are identical in design to the clamping jaw support units 28, 29. The slide rail support units 33, 33*a* support the slide rail 18 on its side facing away from the pipe 4. Matching the conditions for the clamping block 24, the slide rail 18 is detachably connected to the slide rail support units 33, 33*a*.

Viewed in the direction of the bending axis 8, the slide rail support units 33, 33*a* sit on the slide rail support units 34, 34*a* which on their part support the slide rail 19. In the illustrations the slide rail support units 34, 34*a* are obscured and therefore not readily identifiable.

The same applies to the slide rail support units 35, 35*a* that are positioned under the slide rail support units 34, 34*a* and to which the slide rail 20 is removably attached on one side and tangential angles 36, 36*a* on the other side.

The slide rail support units 33, 34, 35 are held together by the tie rod 37, the slide rail support units 33*a*, 34*a*, 35*a* by the tie rod 38. The resulting assemblies of slide rail support units 33, 34, 35; 33*a*, 34*a*, 35*a* are attached to the tangential angles 36, 36*a* by means of the tie rods 37, 38. The tangential angles 36, 36*a* on their part are attached to the longitudinal carriage 39 of a compound cross slide 40. In the direction of a double arrow 41 and thus in the longitudinal direction of the pipe 4 to be processed, the longitudinal carriage 39 is movably guided on a transverse carriage 42 of the compound cross slide 40. The transverse carriage 42 on its part can be moved in the transverse direction of the pipe 4 along a transverse guide 43 of the base 2 of the bending system 1.

The slide rail support units 33, 33*a*, 34, 34*a*, 35, 35*a* jointly constitute a slide rail support 44, the slide rail support units 33, 33*a* are lined up with the topmost level, the slide rail support units 34, 34*a* with the central level, and the slide rail support units 35, 35*a* with the bottom-most bending level of the multilevel bending tool 3.

As indicated in FIGS. 1 to 4, the pipe 4 is processed using the bending tool components at the top level, i.e., the bending die 5, the clamping jaw 9 and the slide rail 18. The bending process as such is performed in traditional fashion.

Accordingly, with the multilevel bending tool 3 open, the first step is to align the pipe 4 in its longitudinal pipe direction and in the direction of its circumference. Next, with a relative movement vis-à-vis the machine frame of the bending machine, the multilevel bending tool 3 is brought into a position in which the pipe 4 can be processed using the tool components of the topmost bending level, i.e., in which the pipe 4 is accommodated in the bending die channel 12 of the bending die 5.

Thereupon the multilevel bending tool 3 is closed. To that effect the clamping block 24 with the attached clamping jaws 9, 10, 11 travels in the transverse direction of the bending axis 8 up to the bending dies 5, 6, 7. The pipe 4 is now clamped between the bending die 5 and the clamping jaw 9. At the same time the transverse carriage 42 is moved to transfer the slide rail support 44 with slide rails 18, 19, 20 in the transverse direction of the pipe 4 and into the operating position next to the workpiece. This causes the pipe 4 to be positioned inside the slide rail channel 21. Based on the now prevailing operating conditions, the swivel arm 27 of the base 2 with its attached clamping jaws 9, 10, 11 is rotated in the direction of the arrow 45 shown in FIG. 1 around the bending axis 8. Concurrently the bending dies 5, 6, 7 rotate in corresponding fashion around the bending axis 8. This pulls the pipe 4, clamped between the bending die 5 and the clamping jaw 9, around the bending die 5, providing it with a leftward bend.

The machine side length of pipe next to the bent pipe section is supported in the transverse direction of the workpiece by slide rail 18. In traditional fashion the slide rail 18 follows the longitudinal movement of the pipe 4 during the processing. This movement of the slide rail 18 is brought about by the corresponding longitudinal travel of the longitudinal carriage 39 on the transverse carriage 42.

The forces acting on the slide rail 18 and on the clamping jaw 9 in the transverse direction of the of the pipe 4 are discharged into the base structure 2 of the bending system 1 by the bottom slide rail support units 35, 35*a* of the slide rail support 44 and, respectively, by the bottom clamping jaw support unit 30 of the clamping block 24. Because of the dimensions of the clamping jaw support unit 30, a large area is available at the clamping block 24 for the energy transfer.

Figure 3:
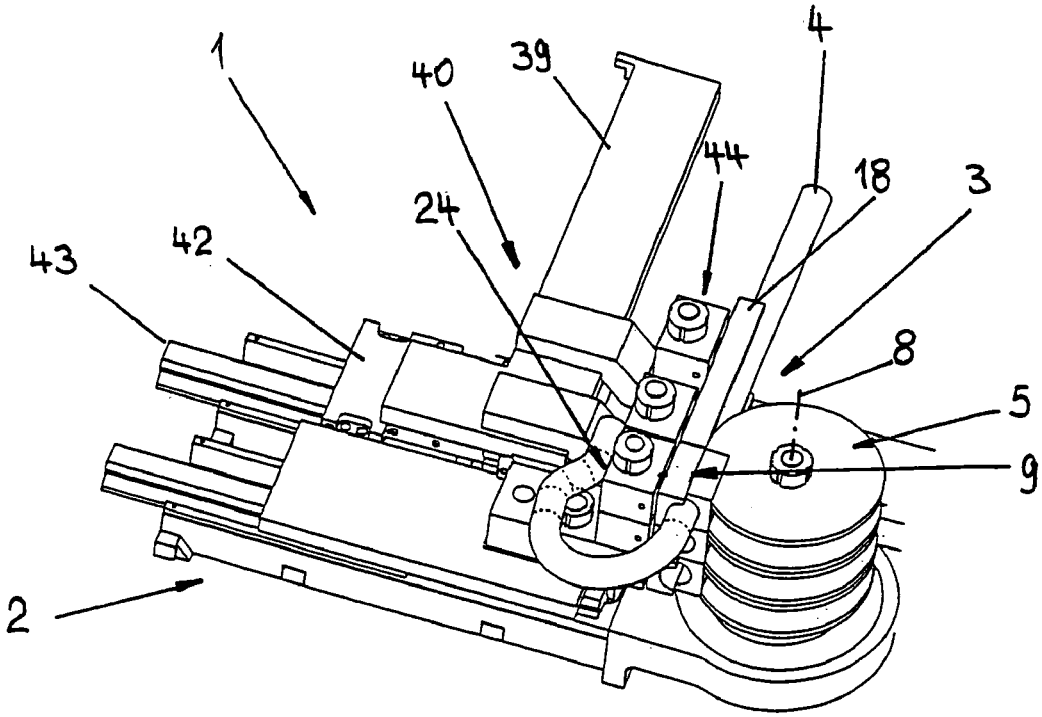
FIG. 3 is a perspective view of the bending system of FIGS. 1 and 2 during the workpiece bending process.
Figure 4:
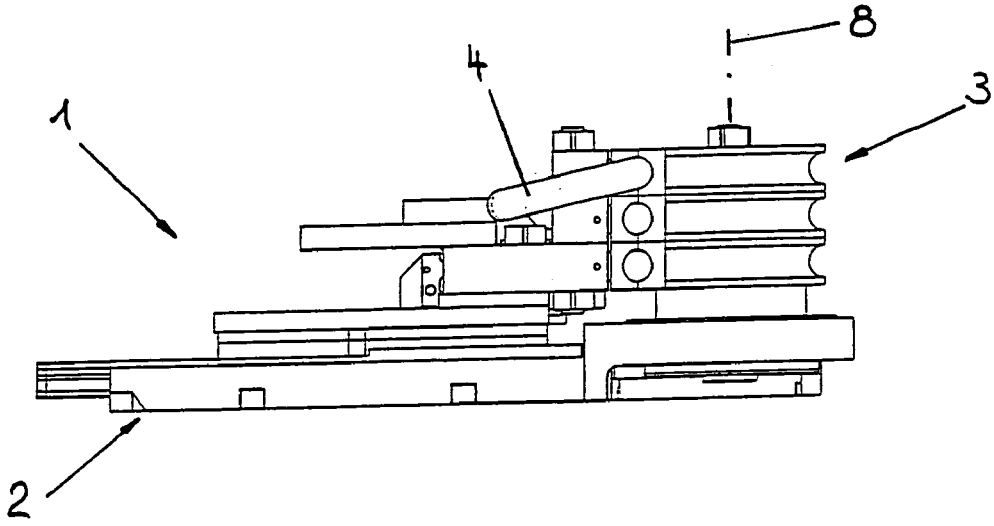
FIG. 4 is a frontal top view of the bending system in FIG. 3.
Figure 5:
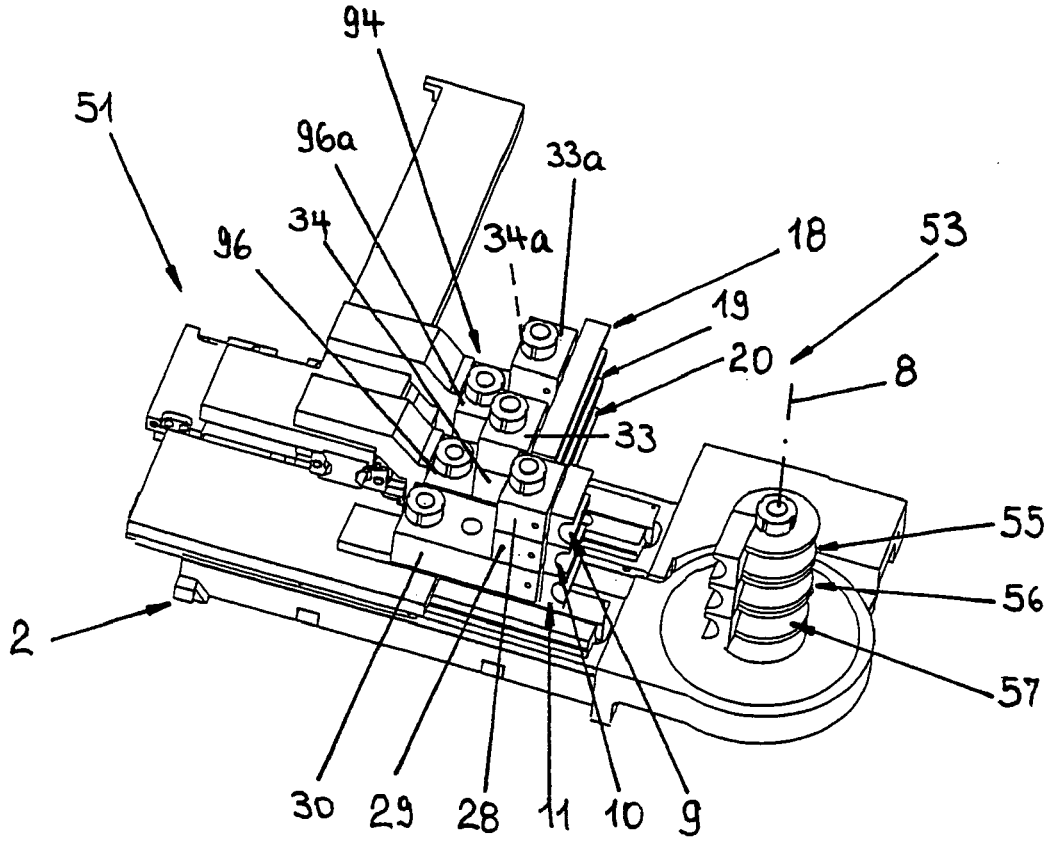
FIG. 5 is a perspective view of a bending system with a multilevel bending tool of a second design, and prior to the bending process.
Figure 6:
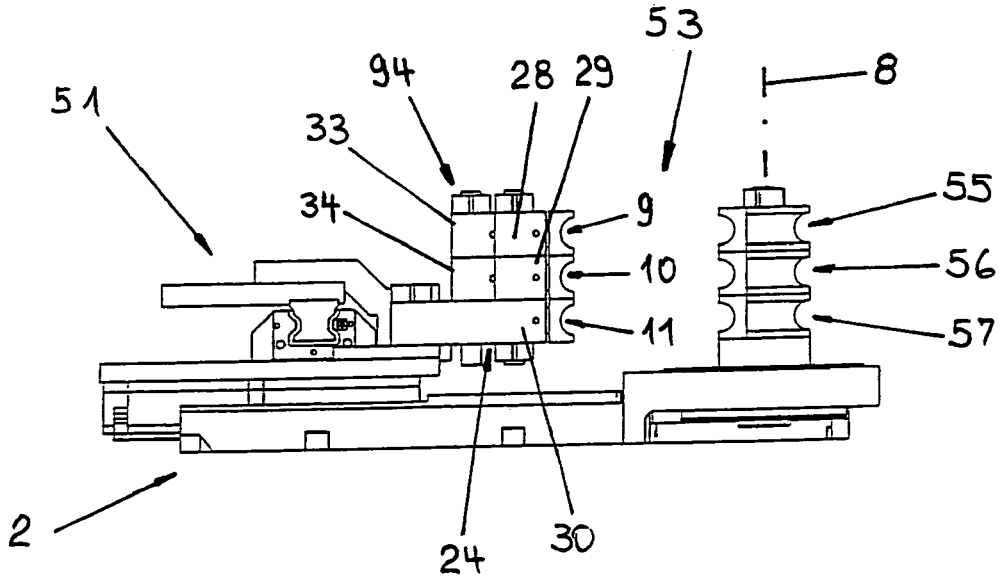
FIG. 6 is a frontal top view of the bending system in FIG. 5.
Figure 7:
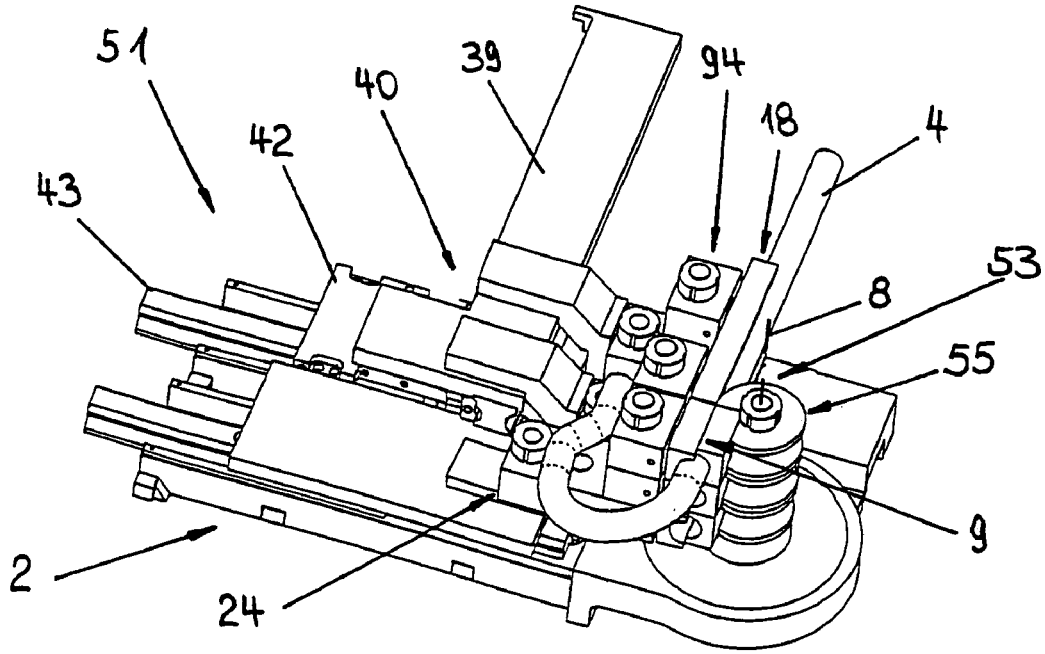
FIG. 7 is a perspective view of the bending system in FIGS. 5 and 6 during the workpiece bending process.
Figure 8:
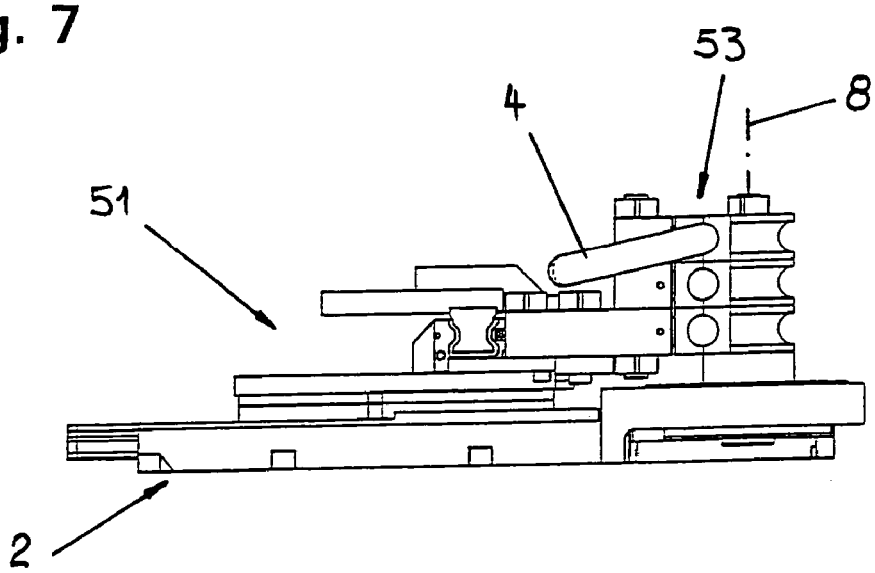
FIG. 8 is a frontal top view of the bending system in FIG. 7.

Apart from single mode processing, the bending system 1 is capable of workpiece multi-processing. FIGS. 3 and 4 illustrate that type of application. They show the pipe 4 in the ready state of the bending system 1 just before a leftward bend is produced. This was preceded by the creation of three bends, ultimately leading to the shape of the pipe 4 at its free end as it exits the multilevel bending tool 3. In order to permit this next bend to be produced in the desired bending plane, the pipe 4 had to be rotated, immediately after the last preceding bend, around its longitudinal axis and into the rotational position shown in FIGS. 3 and 4. This would not have been possible if the clamping block 24 and the slide rail support 44 had not been appropriately configured prior to the start of the workpiece bending process. By arranging the clamping jaw support units 28, 29, 30 and the slide rail support units 33, 33*a*, 34, 34*a*, 35, 35*a* in the manner illustrated, the clamping block 24 and the slide rail support 44 were contoured in a manner that permitted the preshaped end of the pipe 4 to be realigned as shown in FIGS. 3 and 4 while avoiding any collision with the clamping block 24 and the slide rail support 44. The interference contour created by the clamping block 24 and the slide rail support 44 was defined in a way that, in its variously necessary processing positions relative to the bending system 1, the pipe 4 would at all times remain clear of that interference contour.

Corresponding to FIGS. 1 to 4, FIGS. 5 to 8 depict a bending system 51 which differs from the bending system 1 in FIGS. 1 to 4 by the configuration of the multilevel bending tool 53.

The multilevel bending tool 53 comprises bending dies 55, 56, 57 which are of a smaller diameter than the bending dies 5, 6, 7 of the multilevel bending tool 3, thus permitting the production of bends with a smaller bending radius. As in the embodiment of FIGS. 1 to 4, the bending dies 55, 56, 57 are paired up with clamping jaws 9, 10, 11. In the case of the bending system 51 as well, the slide rails 18, 19, 20 are the same as the corresponding tool components in FIG. 1 to 4.

Similarly identical is the structure of the clamping block 24 which in the case of the bending system 51 again consists of clamping jaw support units 28, 29, 30. However, in the case of the bending system 51 as differentiated from the bending system 1, the clamping block 24 has been repositioned on the platen 26 so as to be located closer to the bending axis 8. This compensates for the smaller diameter of the bending dies 55, 56, 57 as compared to that of the bending dies 5, 6, 7.

As another difference from the conditions in FIGS. 1 to 4, the bending system 51 employs a modified slide rail support 94. Specifically, compared to the slide rail support units 33, 33*a* and 34, 34*a*, the slide rail support 94 additionally includes slide rail support units 96, 96*a*. While the slide rail support units 33, 33*a*, 34, 34*a* are identical in their structural design not only to one another but also to the clamping jaw support units 28, 29 of the clamping block 24, the slide rail support units 96, 96*a* are twice the length of the clamping jaw and slide rail support units 28, 29, 33, 33*a*, 34, 34*a* in the transverse direction of the object pipe 4, which is not shown in FIGS. 5 and 6 for simplicity's sake.

All of the clamping jaw support units 28, 29, 30 as well as the slide rail support units 33, 33*a*, 34, 34*a*, 35, 35*a*, 96, 96*a*, illustrated in FIGS. 1 to 8, are modular components of a support unit construction kit out of which the clamping block 24 as well as the slide rail supports 44, 94 are assembled in an application specific configuration. This support unit construction kit contains design-categorized clamping jaw and slide rail support units. In terms of dimensions in the transverse direction of the bending axis 8 and, respectively, of the pipe 4 to be processed, a total of three support unit categories are available. The category with the greatest linear dimension must be paired up with clamping jaw support unit 30, the dimensionally intermediate category must be associated with slide rail support units 96, 96*a*, the smallest category with clamping jaw support units 28, 29 as well as slide rail support units 33, 33*a*, 34, 34*a* and 35, 35*a*. Given their identical design, the slide rail and clamping jaw support units are mutually interchangeable. In terms of elevational height in the direction of the bending axis 8, the support unit construction kit includes two categories. As an alternative to the equal height support units shown in FIG. 1 to 8, support units of greater elevational height are additionally available.

Figure 9:
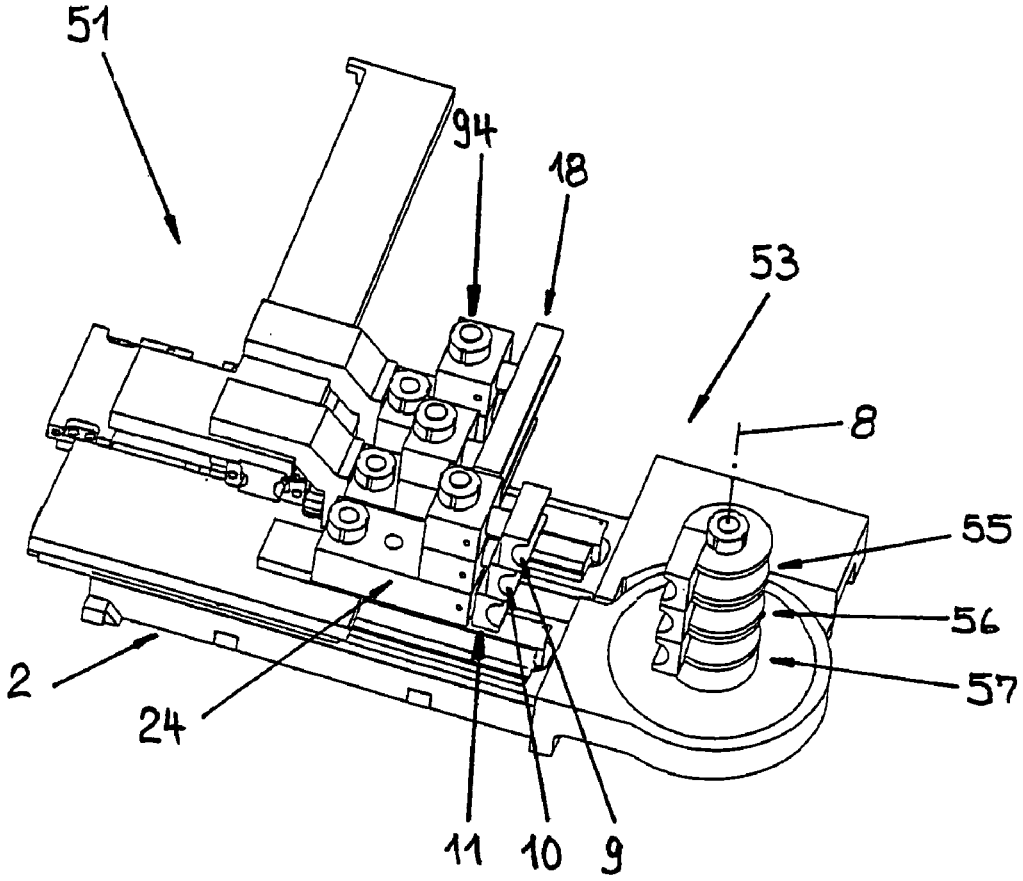
FIG. 9 is a perspective view of the bending system of FIGS. 5 and 6, with clamping jaws and slide rails of the multilevel bending tool repositioned relative to their positions shown in FIGS. 5 and 6.
Figure 10:
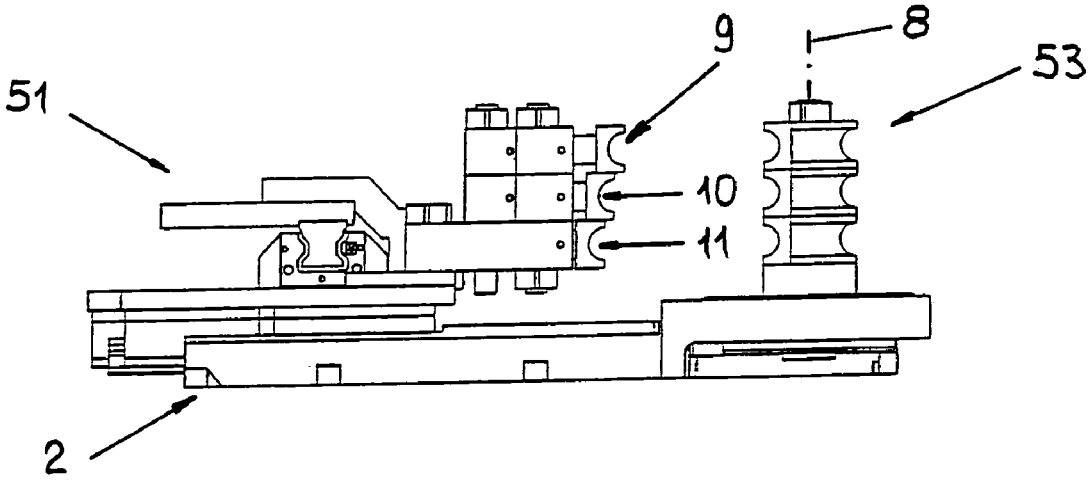
FIG. 10 is a frontal top view of the bending system of FIG. 9.

When setting up the bending system concerned, the machine operator thus has available to him a number of support units from which to make his selection depending on the requirements of the intended workpiece processing. The selected support units will have to be equipped with clamping jaws 9, 10, 11 as well as slide rails 18, 19, 20. In addition, it may be necessary in setting up the bending system 1, 51 to adjust the clamping jaws 9, 10, 11 in the transverse direction of the bending axis 8 and the slide rails 18, 19, 20 in the transverse direction of the pipe 4 to be processed. FIGS. 9 and 10 serve to illustrate the existing adjustment options.

These illustrations allow the visualization of the adjustability of the clamping jaws 9, 10, 11 and slide rails 18, 19, 20 relative to the clamping block 24 on which they are mounted and, respectively, to the slide rail support 94. In the example shown, the clamping jaws 9, 10, 11 are attached to the clamping jaw support units 28, 29, 30, and the slide rails 18, 19, 20 to the slide rail support units 33, 33*a*, 34, 34*a*, 96, 96*a*, in each case by means of threaded set screws that are provided on the clamping jaws 9, 10, 11 and slide rails 18, 19, 20. As an alternative, it is possible to install separate adjusting devices between the clamping jaws 9, 10, 11 and slide rails 18, 19, 20 and the associated clamping jaw and slide rail support units 28, 29, 30, 33, 33*a*, 34, 34*a*, 96, 96*a*. As another option, the assemblies constituted of the bending tool components and their respectively associated support units at the individual levels could be made adjustable relative to one another.

The existing adjustment options can be used for fine adjustment at the individual bending levels but also for the job specific repositioning of the clamping jaws 9, 10, 11 and slide rails 18, 19, 20 when the bending dies are exchanged for bending dies of a different diameter or bending radius.

What is claimed is:

1. A bending system in a bending machine for bending rod shaped and bar-shaped workpieces incorporates at least one multilevel bending tool (3, 53) with multiple bending levels arranged one above the other in the direction of a bending axis (8), said bending tool having at each bending level a bending die (5, 6, 7; 55, 56, 57) and, associated with a corresponding bending die (5, 6, 7; 55, 56, 57), at least one clamping jaw (8, 9, 10) movable in the transverse direction of the bending axis (8) into at least one operating position next to the bending die and into at least one idle position away from the bending die, said clamping jaw(s) (8, 9, 10) being effectively mounted on the their side facing away from the bending dies (5, 6, 7; 55, 56, 57) on a clamping jaw support (24) that can be moved in the transverse direction of the bending axis (8), said clamping jaw support (24) encompassing several clamping jaw support units (28, 29, 30) positioned one above the other in the direction of the bending axis (8) and detachably connected to one another, said clamping jaw support units (28, 29, 30) being distributed over different bending levels.

2. The bending system in accordance with claim 1 wherein at least one clamping jaw (8, 9, 10) is provided at each of the different bending levels and clamping jaw support units (28, 29, 30) are distributed over the different bending levels associated with the clamping jaws (8, 9, 10).

3. A bending system on a bending machine for bending rod shaped and bar-shaped workpieces incorporating at least one multilevel bending tool (3, 53) with multiple bending levels arranged one above the other in the direction of a bending axis (8), said bending tool having at each bending level a bending die (5, 6, 7; 55, 56, 57) and at least one slide rail (18, 19, 20) for bracing the workpiece in the transverse direction of the workpiece and in which, on the side facing away from the workpiece in the transverse direction of the workpiece, the slide rail (18, 19, 20) is effectively mounted on a slide rail support (44, 94) which encompasses several slide rail support units (33, 33*a*, 34, 34*a*, 35, 35*a*, 96, 96*a*) positioned one above the other in the direction of the bending axis (8), said slide rail support units (33, 33*a*, 34, 34*a*, 35, 35*a*, 96, 96*a*) being associatively distributed over different bending levels and detachably connected to one another.

4. The bending system in accordance with claim 3 wherein at least one slide rail (18, 19,20) is provided for each of the different bending levels and wherein the respective slide rail support units (33, 33*a*, 34, 34*a*, 35, 35*a*, 96, 96*a*) associated with the slide rails (18, 19, 20) are correspondingly distributed over the different bending levels.

5. The bending system in accordance with claim 3 wherein at each bending level, a clamping jaw (8, 9, 10) is associated with the corresponding bending die (5, 6, 7; 55, 56, 57) and is movable in the transverse direction of the bending axis (8) into at least one operating position next to the bending die and into at least one idle position away from the bending die and wherein, on the side facing away from the bending dies (5, 6, 7; 55, 56, 57) the clamping jaw (8, 9, 10) is effectively mounted in the transverse direction of the bending axis (8) on a clamping jaw support unit (24) that is movable with the clamping jaw(s) (8, 9, 10) in the transverse direction of the bending axis (8), said clamping jaw support (24) encompassing several clamping jaw support units (28, 29, 30) that are positioned one above the other in the direction of the bending axis (8) and detachably connected to one another, the respectively associated clamping jaw support units (28, 29, 30) are correspondingly distributed over the different bending levels.

6. The bending system in accordance with claim 5 wherein, at each of the different bending levels, at least one clamping jaw (8, 9, 10) is provided and the respectively associated clamping jaw support units (28, 29, 30) are correspondingly distributed over the different bending levels.

7. The bending system in accordance with claim 5 wherein at least one clamping jaw support unit (28, 29, 30) and at least one slide rail support unit (33, 33*a*, 34, 34*a*, 35, 35*a*, 96, 96*a*) are identical in their structural design.

8. The bending system in accordance with claim 3 wherein at least one clamping jaw (8, 9, 10) of at least one bending level is adjustably mounted on the associated clamping jaw support unit or units (28, 29, 30) in a manner as to permit being repositioned especially in the transverse direction of the bending axis (8).

9. The bending system in accordance with claim 3 wherein at least one slide rail (18, 19, 20) at at least one bending level is adjustably mounted on the associated slide rail support units (33, 33*a*, 34, 34*a*, 35, 35*a*, 96, 96*a*) for repositioning the workpiece.

10. The bending system in accordance with claim 3 wherein the clamping jaw support units (28, 29, 30) and the slide rail support units (33, 33*a*, 34, 34*a*, 35, 35*a*, 96, 96*a*) are categorized by their respective designs.

11. The bending system in accordance with claim 10 wherein the clamping jaw support units (28, 29, 30) are categorized by their linear dimension in the transverse direction of the bending axis (8), and the slide rail support units (33, 33*a*, 34, 34*a*, 35, 35*a*, 96, 96*a*) are categorized by their linear dimension in the transverse direction of the workpiece.

12. The bending system in accordance with claim 10 wherein the clamping jaw support units (28, 29, 30) and slide rail support units (33, 33*a*, 34, 34*a*, 35, 35*a*, 96, 96*a*) are structurally categorized by their linear dimension in the direction of the bending axis (8).

13. A clamping jaw support unit for a bending system on a bending machine for bending rod-shaped and bar-shaped workpieces incorporating at least one multilevel bending tool (3, 53) with multiple bending levels arranged one above the other in the direction of a bending axis (8), said bending tool having at bending level a bending die (5, 6, 7; 55, 56, 57) and, associated with the corresponding bending die (5, 6, 7; 55, 56, 57), at least one clamping jaw (8, 9, 10) movable in the transverse direction of the bending axis (8) into at least one operating position next to the bending die and into at least one idle position away from the bending die, said clamping jaw support unit (24) mounting the clamping jaw thereon and being movable in the transverse direction of the bending axis (8), said clamping jaw support (24) encompassing several clamping jaw support units (28, 29, 30) positioned one above the other in the direction of the bending axis (8) and detachably connected to one another, and said clamping jaw support units (28, 29, 30) being distributed over different bending levels.

14. A slide rail support unit for a bending system on a bending machine for bending rod-shaped and bar-shaped workpieces incorporating at least one multilevel bending tool (3, 53) with multiple bending levels arranged one above the other in the direction of a bending axis (8), said bending tool having at each bending level a bending die (5, 6, 7; 55, 56, 57) and at least one slide rail (18, 19, 20) for bracing the workpiece in the transverse direction of the workpiece and in which, on the side facing away from the workpiece in the transverse direction of the workpiece, the slide rail(s) (18, 19, 20) is effectively mounted on a slide rail support (44, 94) which encompasses several slide rail support units (33, 33*a*, 34, 34*a*, 35, 35*a*, 96, 96*a*) positioned one above the other in the direction of the bending axis (8), said slide rail support units (33, 33*a*, 34, 34*a*, 35, 35*a*, 96, 96*a*) being associatively distributed over different bending levels and detachably connected to one another.

* * * * *